United States Patent [19]

Lutfy

[11] Patent Number: 4,811,666

[45] Date of Patent: Mar. 14, 1989

[54] SOLID PROJECTILES

[76] Inventor: Eric A. Lutfy, 125 E. Missouri Ave., Phoenix, Ariz. 85012

[21] Appl. No.: 140,385

[22] Filed: Jan. 4, 1988

[51] Int. Cl.[4] ..... F42B 11/00

[52] U.S. Cl. ..... 102/501; 102/307; 102/476; 420/475

[58] Field of Search ..... 102/306, 307, 476, 501; 420/475

[56] References Cited

U.S. PATENT DOCUMENTS

| | | | |
|---|---|---|---|
| 296,958 | 4/1884 | Hebler | 102/58 |
| 844,675 | 2/1907 | Hadfield | 102/37 |
| 3,655,367 | 4/1972 | Bleecker | 420/475 |
| 3,773,569 | 11/1973 | Edelman et al. | 148/11.5 F |
| 3,888,636 | 6/1975 | Sczerzenie et al. | 29/182 |
| 3,911,820 | 10/1975 | Canon | 102/38 |
| 3,946,673 | 3/1976 | Hayes | 102/52 |
| 3,972,286 | 8/1976 | Canon | 102/38 |
| 4,109,581 | 8/1978 | Six | 102/92.1 |
| 4,417,929 | 11/1983 | Tomaru | 420/475 X |
| 4,498,395 | 2/1985 | Kock et al. | 102/517 |
| 4,610,204 | 9/1986 | Dunne et al. | 102/476 |
| 4,749,410 | 6/1988 | Mullendore et al. | 102/501 X |

*Primary Examiner*—Peter A. Nelson

*Attorney, Agent, or Firm*—Warren F. B. Lindsley

[57] ABSTRACT

A projectile of a predetermined geometrical configuration for small arms ammunition which comprises a solid monolithic body made of a copper alloy of approximately 61.5% of copper, approximately 35% of zinc, approximately 3% of lead and approximately 0.5% of tin.

8 Claims, 3 Drawing Sheets

SOLID PROJECTILES

BACKGROUND OF THE INVENTION

The study of ballistics involves the applied science as directed to the shape and motion of a projectile, not only in the bore of a gun, but also in flight and after it has impacted on a target.

Modern projectiles or bullets for small arms ammunition, i.e. 0.20 mm and smaller, are made exactly to size, with only the slightest manufacturing tolerances permitted. Lead bullets are made of a hardened alloy, and are shaped cold in dies from extruded wire of the proper size. The bullets are jacketed with a hard metal with the jackets being stamped from sheet stock, and drawn in dies to the proper shape and thickness. A lead slug is then inserted in the jacket and the whole is assembled in a press. A hard surfaced bullet of this type permits the use of a shallow rifling with a depth of 0.004 inch being common with stripping or fouling of the grooves by bullet metal being reduced, especially at high bore velocities.

A bullet may be intended either to expend its kinetic energy on the target, or to perforate and pass through with considerable remaining energy. Increasing the velocity offers an attractive method of increasing the available kinetic energy. Permissible pressure in the barrel of the gun, however, is limited, and substantial increases in velocity are most often obtained by reducing the weight of the bullet which reduces its capacity to maintain flight against air resistance and the target. Hence, high velocity bullets are more effective at the shorter ranges, while heavier, slower bullets have a greater total range and penetration.

Expansive bullets tend to deform and expend a maximum of their energy on the target. They expand upon contact with living tissue and produce great internal damage. All soft bullts and soft-nose, split-nose or hollow-point jacketed bullets are of this type.

In modern big game hunting, a need exists for nonexpansive bullets and increased bullet stability, thereby makingtthem capable of penetrating straighter and deeper than other heavier bullets of the same caliber. These bullets should have a good ballistic shape, uniform weight and symmetry for true flight.

DESCRIPTION OF THE PRIOR ART

Modern bullets for small arm use have been made of various lead alloys which have been jacketed. Most of these bullets rupture and distort as the bullet nose flexes on impact, causing the bullet to wobble and change its path during penetration.

U.S. Pat. No. 296,958 discloses a bullet having an alloy composed of lead and tin or lead and antimony, having a long slender configuration with a sharply pointed nose.

U.S. Pat. No. 4,109,581 discloses a projectile for an infantry rifle which comprises a solid projectile body made of soft iron made of an alloy of low carbon steels.

U.S. Pat. No. 844,675 discloses armor piercing projectiles which are cast or forged of nickel-chromium steel.

U.S. Pat. No. 4,498,395 discloses a heterogeneous fine alloying powder of tungten with sponge-like binder outer coating of at least one metal and process of preparation for penetrating shells.

U.S. Pat. Nos. 3,773,569; 3,888,636 and 3,946,673 disclose projectiles formed of various alloys of different metallic content.

SUMMARY OF THE INVENTION

In accordance with the invention claimed, a new and improved projectile or bullet is disclosed, having a novel geometrical configuration, as well as alloy composition of a nonexpansive type, which is capable of penetrating straighter and deeper than other bullets of the same or like caliber.

It is, therefore, one object of this invention to provide a new and novel nonexpansive projectile having a geometrical configuration which aids in maintaining its flight and twist rate, causing it to penetrate straighter and deeper than similar calibrated projectiles.

Another object of this invention is to provide a new and improved nonexpansive bullet or projectile which will penetrate straighter and deeper without deforming than the bullets in similar calibrated projectiles.

A further object of this invention is to provide a new and improved Monolithic Solid bullet of a homogeneous type. Monolithic Solid is a trademark of A-Square Co., Inc. of Madison, Ind.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
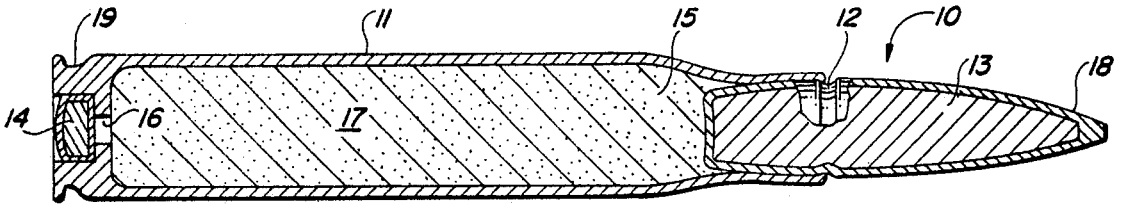
FIG. 1 (PRIOR ART)
FIG. 1 is a cross-sectional view of a conventional shell showing the parts thereof.

Referring more particularly to the drawings by characters of reference, FIG. 1 discloses a prior art cartridge 10 comprising an elongated casing 11 which is tapered inwardly at its right end, as shown, to provide an inwardly projecting ridge 12 which, by crimping, engages and tightly holds an elongated lead alloy jacketed slug, bullet or projectile 13. The other end of cartridge 10 is provided with a primer 14 which is in direct contact with the hollow interior 15 of the cartridge by a passageway 16.

The interior of the cartridge is provided with a powder charge 17, sufficient to provide the projectile shown with a velocity of approximately 2600 feet per second at approximately 78 feet from the muzzle of the barrel in which the cartridge is fired.

As shown in FIG. 1, projectile 13 is encased in a gliding metal jacket 18 formed of an alloy of 95% copper and 5% of zinc, and the left end of the shell is provided with an extracting groove 19, all well knon in the art.

Figure 2:
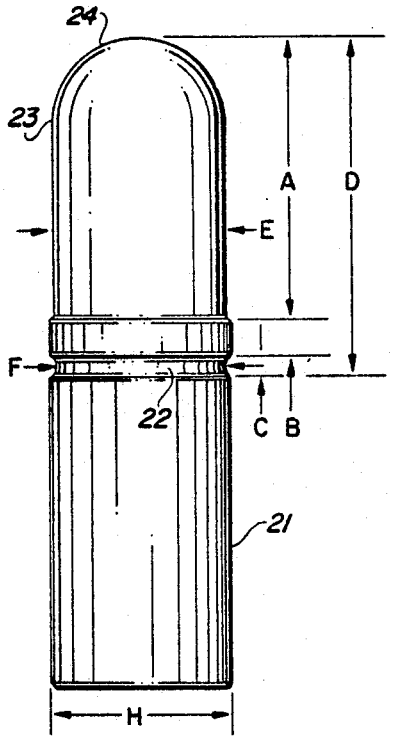
FIG. 2 is a perspective view of a Monolithic Solid projectile embodying the invention illustrating the various characteristics thereof.

FIG. 2 illustrates a solid monolithic bullet or projectile 20 embodying the invention for mounting in the casing of a cartridge not shown. This casing may be similar to the cartridge casing 11 shown in FIG. 1.

In accordance with the invention disclosed and claimed, projectile 20 comprises a hemispherical round-nosed parallel-sided homogeneous elongated solid formed of a given alloy. Base end 21 of the projectile forms a cylindrical configuration having a cannelure 22 of a given depth formed around its circumference at a suitable point along its length. The cannelure receives the inwardly projecting ridge of an associated cartridge in a crimping, sealing manner, as shown in FIG. 1.

The top end 23 of the projectile is provided with a crown-shaped or hemispherical end 24 that forms a blunt target engaging surface that substantially balances the impact forces and transmits them axially along the length of the projectile.

FIG. 2 indentifies other features or parts of projectile 20 by reference characters A through F which vary according to the following table for diameters and weights of a range of the projectiles disclosed. The column identified as H comprises the dimension of the hole in the barrel of the associated weapon through which the projectile is ejected.

MONOLITHIC SOLID PROJECTILES (DIMENSIONS)

| Dia. | Wt. | A | B | C | D | E | F | G | H |
|---|---|---|---|---|---|---|---|---|---|
| .284 | 175 | .640 | .120 | .050 | .810 | .274 | .256 | .014 | .2844 |
| .308 | 180 | .570 | .120 | .050 | .740 | .298 | .280 | .014 | .3086 |
| .308 | 220 | .645 | .120 | .050 | .815 | .298 | .280 | .014 | .3086 |
| .323 | 220 | .655 | .120 | .050 | .825 | .310 | .295 | .014 | .3233 |
| .338 | 250 | .680 | .120 | .040 | .840 | .327 | .310 | .014 | .3382 |
| .366 | 286 | .700 | .120 | .050 | .870 | .353 | .336 | .015 | .3663 |
| .375 | 300 | .640 | .110 | .050 | .800 | .364 | .345 | .015 | .3752 |
| .409 | 400 | .700 | .100 | .050 | .850 | .395 | .379 | .015 | .4092 |
| .416 | 400 | .650 | .120 | .050 | .820 | .405 | .386 | .015 | .4161 |
| .423 | 400 | .500 | .120 | .050 | .670 | .411 | .393 | .015 | .4231 |
| .458 | 465 | .730 | .100 | .040 | .870 | .444 | .428 | .015 | .4583 |
| .458 | 500 | .700 | .120 | .050 | .870 | .447 | .428 | .015 | .4582 |
| .468 | 480 | .610 | .100 | .050 | .760 | .456 | .438 | .015 | .4685 |
| .475 | 500 | .610 | .100 | .050 | .760 | .463 | .445 | .015 | .4758 |
| .488 | 500 | .460 | .080 | .050 | .590 | .472 | .458 | .015 | .4883 |
| .505 | 525 | .490 | .080 | .050 | .620 | .491 | .475 | .015 | .5054 |
| .510 | 707 | .710 | .100 | .050 | .860 | .499 | .480 | .015 | .5107 |
| .585 | 750 | .670 | .080 | .050 | .780 | .571 | .555 | .015 | .5855 |

Although soft iron made of an alloy of low carbon steels with less than 0.04% of carbon, 0.20% of manganese, 0.05% to 0.18% of aluminum, 0.035% of phosphorus and 0.035% of sulphur have been known for projectiles for rifle and light automatic weapons of below 5.56 mm caliber shells, the solid monolithic projectiles disclosed herein for deeper and straighter penetration without rupturing or flattening are believed to be novel and unobvious to one skilled in this art.

The disclosed solid monolithic bullet or projectile 20 disclosed herein, as set forth in FIG. 2, may be formed of a copper alloy comprising approximately 61.5% copper, 35% zinc, 3% lead and 0.5% tin. These percentages may vary 20 to 40 percent. The tensile strength of the bullet formed of this alloy is approximately 65,000 pounds per square inch, with a yield strength at 57,000 pounds per square inch for a 0.2% offset.

In previously used projectiles which consist of a tubing or conventional solid type configuration, the projectiles failed by rupturing or flattening upon impact with the target. This occurs because of jacket failure in ordinary solid projectiles, causing the side wall or base of the projectile to rupture as the projectile nose flexes on impact. This type of failure will change the path of the projectile or prevent the projectile from penetrating the target in a straight path.

This problem has been eliminated by the configuration and alloy material of the projectile disclosed and claimed herein.

Figure 5A:
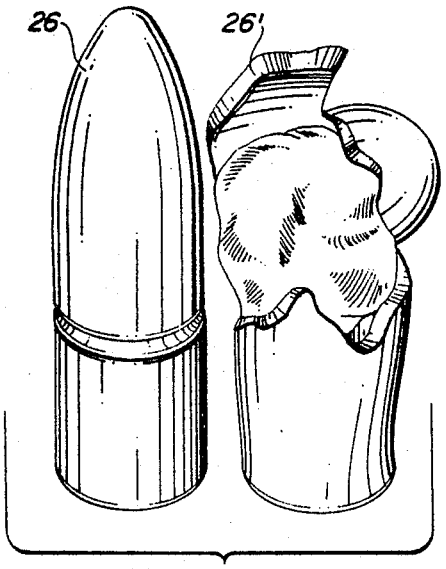
FIGS. 5A–5C are perspective views of various competitor projectiles before and after impacting a target.
Figure 5B:
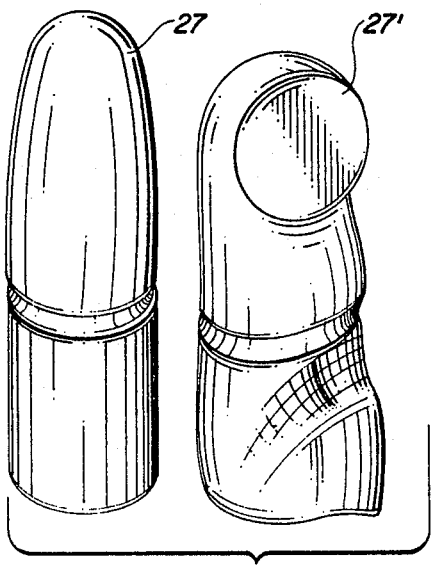
Figure 5C:
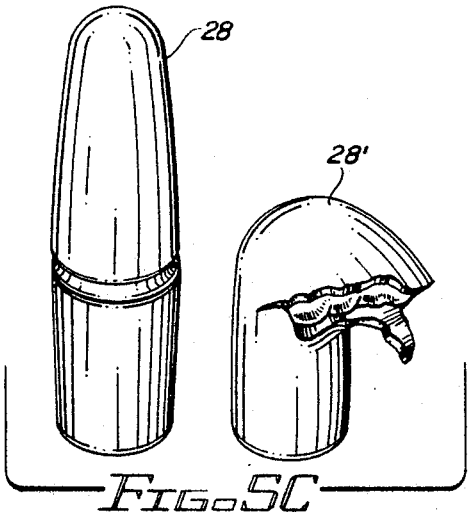

FIGS. 5A–5C disclose the before and after firing of three conventional projectiles identified as 26, 26'; 27, 27' and 28, 28', respectively, which penetrated their targets with bullets 26, 26' being a conventional .510 tubing style; 27, 27' being a conventional .458 solid type and 28, 28' being a .375 solid conventional type projectile.

Figure 4:
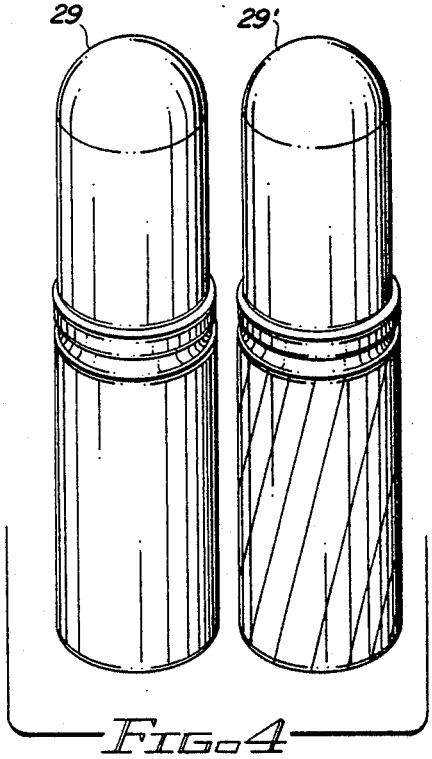
FIG. 4 is a perspective view of the before and after firing of one embodiment of the claimed projectile.

FIG. 4 discloses the before and after configuration of a novel 0.510 Monolithic Solid projectile of 707 grains, identified as 29, 29', disclosed and claimed herein showing relatively no distortion of the bullet after impact and penetration of the target.

Figure 6:
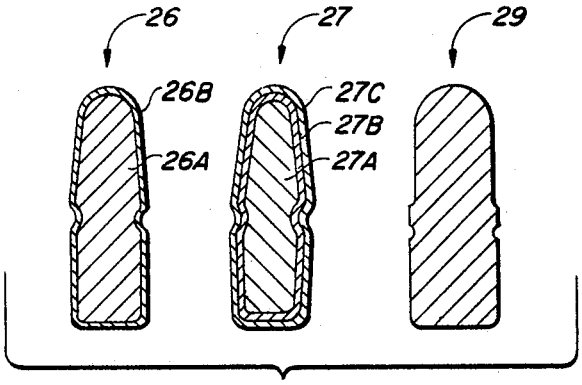
FIG. 6 is a cross-sectional view of a standard tubing style solid projectile, a conventional solid type projectile and the claimed novel configuration.

FIG. 6 discloses a cross-sectional view of projectiles 26, 27 and 29 of FIGS. 4 and 5A–5C.

Figure 7:
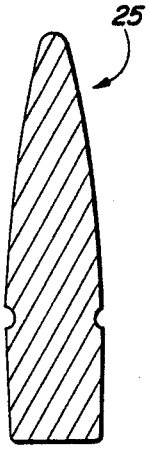
FIG. 7 is a perspective view of a modification of the projectile shown in FIGS. 2–4.

FIG. 7 discloses a pointed elongated homogeneous solid projectile 25 which is formed of the same alloy material as disclosed for projectile 20, shown in FIG. 2.

Monolithic Solid projectiles of the above mentioned alloy, when compared with standard U. S. Government ammunition, both loaded to the same breach pressure, will exceed the velocity with less barrel heat than the standard U.S. Government ammunition. When the cartridge is loaded to obtain the same velocity, the disclosed projectile will have less pressure and barrel heat in the associated weapon, even though the disclosed Monolithic Solid projectile weighs about 7% more than the U. S. Government projectile.

Figure 9:
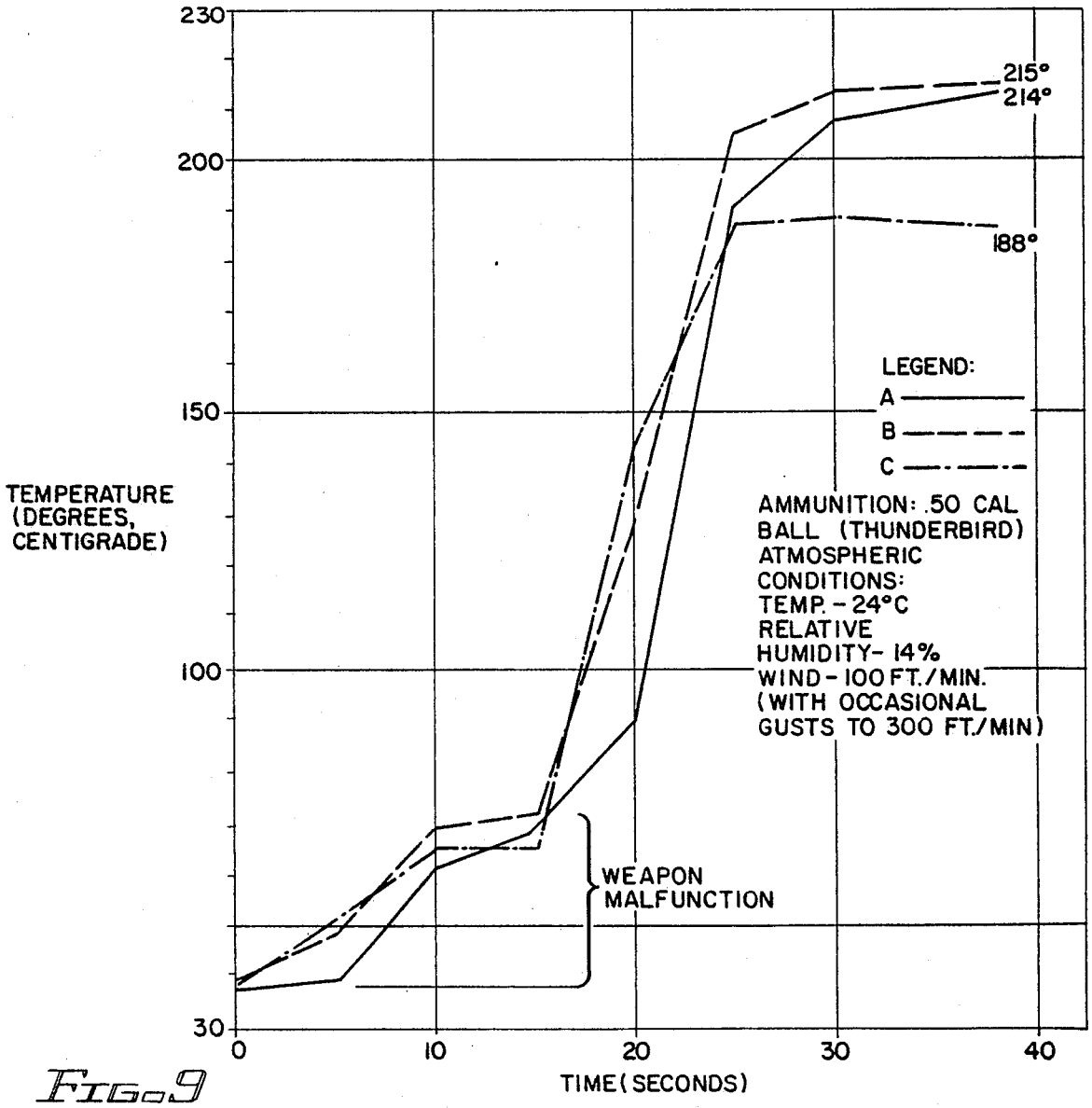
FIG. 9 is a graphic illustration of temperature versus time at the same points on the barrel of the same rifle using the same ammunition as used in the test shown in FIG. 8 embodying in the cartridge the claimed projectile.
Figure 8A:
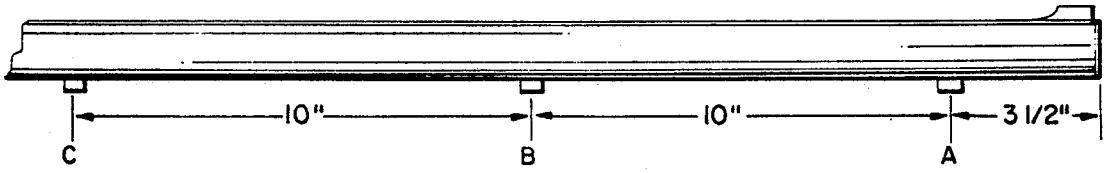
FIG. 8A is a partial view of a rifle barrel showing the position of sensors A, B and C used for obtaining temperature readings which are graphically illustrated in FIGS. 8B and 9.
Figure 8B:
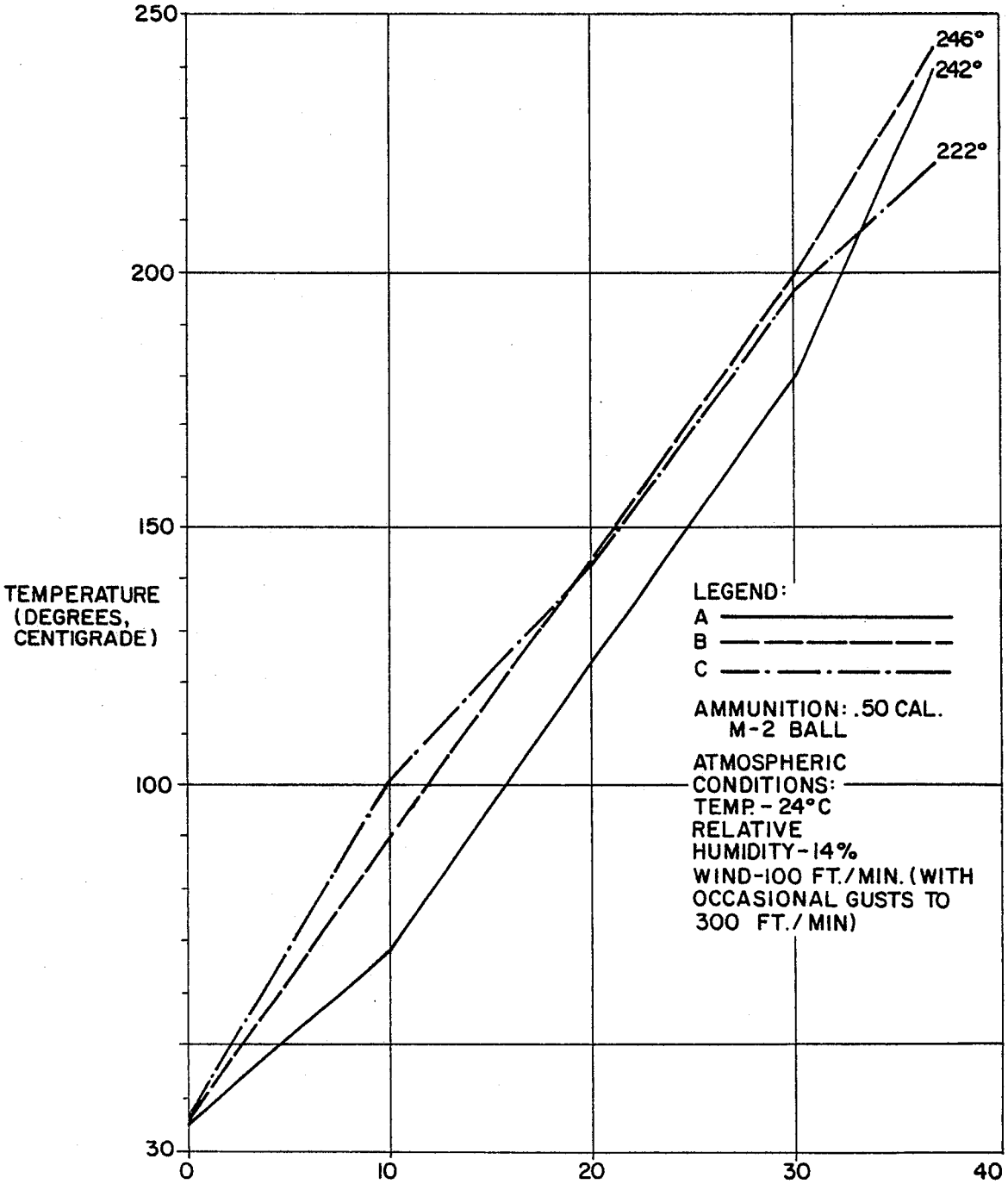
FIG. 8B is a graphic illustration of temperature versus time at various points on the barrel of a rile firing standard U. S. Government ammunition.

FIGS. 8B and 9 are graphic illustrations, respectively, of temperature variations of the barrel of a weapon fired with standard ammunition having the known projectile and with the same cartridge, but embodying the claimed projectile at the sensor positions shown in FIG. 8A.

FIG. 8B represents the temperature conditions or reading of a first thermal couple A placed 3½ inches from the muzzle crown of the rifle, and a second thermal couple B placed 10 inches to the rear of the first thermal couple and a third thermal couple C placed 10 inches to the rear of the second thermal couple for standard .50 caliber U.S. Government ammunition.

This test was conducted on Nov. 6, 1985 at the University of Arizona, with atmospheric temperatures of 24 degrees C., 14% relative humidity and wind velocity of 100 feet per minute with occasional gusts of up to 300 feet per minute.

Figure 3:
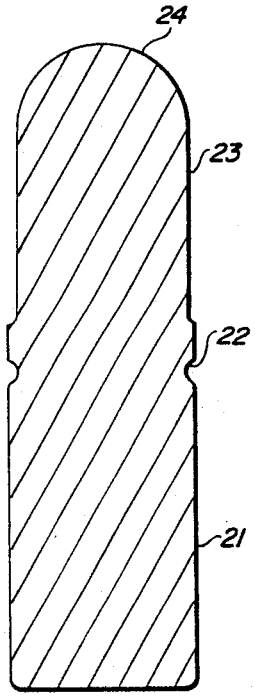
FIG. 3 is a cross-sectional view of FIG. 2.

FIG. 9 illustrates the temperature versus time conditions of the same points on the barrel of the same rifle taken on the same day with the same .50 caliber ammunition, except that the projectile used in this test was the projectile shown in FIGS. 2–4 and claimed herein.

As evident from FIGS. 8B and 9, the claimed projectile was fired from the barrel of a rifle, causing a substantially reduced temperature rise of the barrel over that occuring when standard U. S. Government ammunition was used in the same rifle.

Since the barrel temperature must be controlled, especially in automatic and semi-automatic weapons, this improvement is beneficial.

In accordance with the teaching of this invention, a new and improved projectile or bullet has been dislosed and claimed of a solid monolithic type, which penetrates deeper and straighter than any bullets of the prior art, because of its homogeneous alloy structure, composition and geometrical configuration.

An improved projectile is thus disclosed in accordance with the stated objects of the invention and, although but a few embodiments of the invention have been illustrated and described, it will be apparent to those skilled in the art that various chages and modifications may be made therein without departing from the spirit of the invention or from the scope of the appended claims.

What is claimed is:

1. A projectile for small arms ammunition comprising:

a projectile body made of a homogeneous solid material, said material comprising a copper alloy consisting of approximately 61.5% of copper, approximately 35% of zinc, approximately 3% of lead and approximately 0.5% of tin.

2. The projectile set forth in claim 1 wherein:

the amount of said copper, zinc, lead and tin can vary 20–40 percent.

3. The projectile set forth in claim 1 wherein:

said projectile body has a tensile strength of approximately 65,000 pounds per square inch, a yield strength of approximately 57,000 pounds per square inch for a 0.2% offset.

4. The projectile set forth in claim 1 wherein:

the outer configuration of said projectile body comprises cylindrical guide portions extending between its ends of a diameter as large as the maximum inside diameter of the barrel of an associated weapon through which the projectile is intended to travel, and a rounded tip forming the nose of the projectile.

5. The projectile set forth in claim 4 wherein:

said body comprises a base, cylindrical walls and a nose, said walls being formed substantially perpendicular to said base of said projectile.

6. The projectile set forth in claim 5 wherein:

said nose comprises a hemispherical configuration.

7. The projectile set forth in claim 6 wherein:

said alloy comprises approximately 61.5% of copper, approximately 35% of zinc, approximately 3% of lead and approximately 0.5% of tin.

8. The projectile set forth in claim 7 wherein:

said projectile body has a tensile strength of approximately 65,000 pounds per square inch, a yield strength of approximately 57,000 pounds per square inch for 0.2% offset.

* * * * *